United States Patent [19]

Tozer

[11] Patent Number: 4,917,386

[45] Date of Patent: Apr. 17, 1990

[54] APPARATUS AND METHOD OF PLAYING A BOARD GAME SIMULATING A RACE

[76] Inventor: W. James Tozer, 777 E. South Temple - 12F, Salt Lake City, Utah 84102

[21] Appl. No.: 370,026

[22] Filed: Jun. 22, 1989

Related U.S. Application Data

[63] Continuation of Ser. No. 189,114, May 2, 1988, abandoned.

[51] Int. Cl.[4] ..... A63F 3/00

[52] U.S. Cl. ..... 273/246; 273/274; 273/286

[58] Field of Search ..... 273/246, 274, 286, DIG. 8

[56] References Cited

U.S. PATENT DOCUMENTS

| | | | |
|---|---|---|---|
| D. 42,924 | 8/1912 | Moss | 273/274 |
| 459,929 | 9/1891 | Fichtner | 273/246 |
| 1,660,505 | 2/1928 | Hacker | 273/246 |
| 1,797,742 | 3/1931 | Ward | 273/246 |
| 2,062,168 | 11/1936 | Entwistle | 273/246 |
| 2,727,746 | 12/1955 | Hawkes | 273/246 |
| 3,251,600 | 5/1966 | Warnberg | 273/DIG. 8 |
| 3,560,127 | 2/1971 | Imperato | 273/246 |
| 4,060,246 | 11/1977 | Ward | 273/246 |
| 4,082,289 | 4/1978 | Merritt | 273/246 |
| 4,624,463 | 11/1986 | Glennon | 273/246 |
| 4,729,568 | 3/1988 | Welsh | 273/246 |

FOREIGN PATENT DOCUMENTS

| | | | |
|---|---|---|---|
| 929317 | 7/1947 | France | 273/246 |
| 20635 | of 1910 | United Kingdom | 273/246 |
| 841727 | 7/1960 | United Kingdom | 273/246 |

*Primary Examiner*—Benjamin Layno

*Attorney, Agent, or Firm*—Brumbaugh, Graves, Donohue & Raymond

[57] ABSTRACT

A game for simulating a race of equal moves comprising a playing surface having a plurality of racing lanes each being subdivided into an equal number of advancement spaces including a starting space and a finishing space. A plurality of playing pieces correspond to the number of racing lanes. Dice are used for determining the advancement of said playing pieces. Indicia on the board determines the probability of advancing the playing piece, where the probability of at least one playing piece being advanced and reaching the finishing space first is different from that of the other playing pieces.

18 Claims, 2 Drawing Sheets

APPARATUS AND METHOD OF PLAYING A BOARD GAME SIMULATING A RACE

This is a continuation, of application Ser. No. 189,114 filed May 2, 1988 now abandoned.

FIELD OF THE INVENTION

This invention relates to board games, and more particularly, to a board game which simulates a quarter horse race.

PRIOR ART

Many different board games are known in the art, including games which simulate or represent various types of races. One such game simulating a horse race is described in U.S. Pat. No. 4,060,246 to WARD. The game described in the WARD patent has a play panel marked with indicia defining a number of score columns for eleven named horses. A pair of dice are rolled to obtain eleven numbers from two to twelve, representing the eleven horses, and a finish number which is the lowest common multiple of the numbers 1, 2, 3, 4, 5 and 6 representing ways in which the eleven horse numbers can be rolled by the dice. A chance equalizing number for each player number or horse number is obtained by dividing the lowest common multiple number with the number of ways the play number can be rolled by the dice. The play panel indicia include spaces for marking the number of "gallops" or advances obtained for each horse upon roll of the dice, with a "gallop length" for each horse being calculated by using the number representing the number of ways in which that horse number can be rolled with the dice. A predetermined number is assigned for a race of one furlong, two furlongs, etc., and the first horse attaining that number by rolls of the dice is the winner.

U.S. Pat. No. 4,624,463 describes an Indy Class 500 race game in which the first person to complete 20 "laps" around the game board is the winner. In order to advance, the players must properly answer questions relating to motor racing. Dice are rolled in order to determine the number of spaces each "car" advances in each move, with the further requirement that a question or other obstacle for that space must be properly answered.

SUMMARY OF THE INVENTION

An object of this invention is to provide a board game which simulates a horse race, and wherein the play is simple and realistic and does not require the calculation of odds or other complicated factors affecting the outcome of the game.

A further object of the invention is to provide a board game which simulates a horse race, in which a board is marked with indicia designating a racing lane for each horse, and in which the advancement of miniature horse figures along the racing lanes is determined by rolling two dice, with each horse having pre-assigned odds of winning based on the likelihood of the number of that horse being obtained upon rolling the dice.

Another object of the invention is to provide a board game which simulates a horse race, in which racing lanes are provided on the board along which miniature horses advance when their number is obtained upon rolling a pair of dice, and in which only three advancing moves are required for a horse to win, thus providing a fast-paced game.

Yet another object of the present invention is to provide a board game for simulating a horse race, in which racing lanes are provided on the board for each of the horses, with indicia designating a starting box for each horse, a finish line and a number of spaces for advancement of the horses along their respective racing lanes, and wherein further indicia is duplicated on each of the four sides of the board around its periphery, giving each horses name, the odds for that horse winning, the number of that horse, and two spaces for placing bets on each horse.

A still further object of the invention is to provide a board game which simulates a horse race, in which each horse is assigned a number and a pair of dice are rolled to obtain a number representing one of the horses, which is then advanced one space, and wherein the odds for each horse winning are calculated according to a fair betting odds procedure, with each player being required to place equal total bets for each race, albeit on different horses.

The foregoing and other objects and advantages of the invention are accomplished by providing a playing surface marked with indicia to form a racing lane for each of seven miniature horse figures, in which each racing lane includes a starting box or space, three advancement spaces and a finish line. Each horse has a name and a number from two to twelve, and a pair of dice marked with spots from one to six on respective sides are rolled to obtain a number representing one of the horses which is then advanced one space along its lane. Duplicate indicia are provided along each of the four sides of the playing surface, giving each horses name, its number, the odds of that horse winning the race, and two spaces for placing a bet or bets on that horse.

Only three advancing moves are required for a horse to win a race, and, depending upon the number of players participating, eight or more races are required to complete a game, with three games being required to declare a winner. The winner is determined by ascertaining the player having the highest number of points at the conclusion of the three games. Points are awarded to players based on their bets and whether their horse won or lost a race. All players are required to make the same total point bet in each race, although they may obviously bet on different horses. The odds of each horse winning are calculated according to a fair betting odds procedure, wherein a large number of races are actually conducted and the winning percentage of each horse calculated.

BRIEF DESCRIPTION OF THE DRAWINGS

These and other advantages of the invention will become apparent from the following detailed description taken in conjunction with the accompanying drawings, in which like reference characters designate like parts throughout the several views, and wherein.

DETAILED DESCRIPTION OF THE PREFERRED EMBODIMENTS

Figure 1:
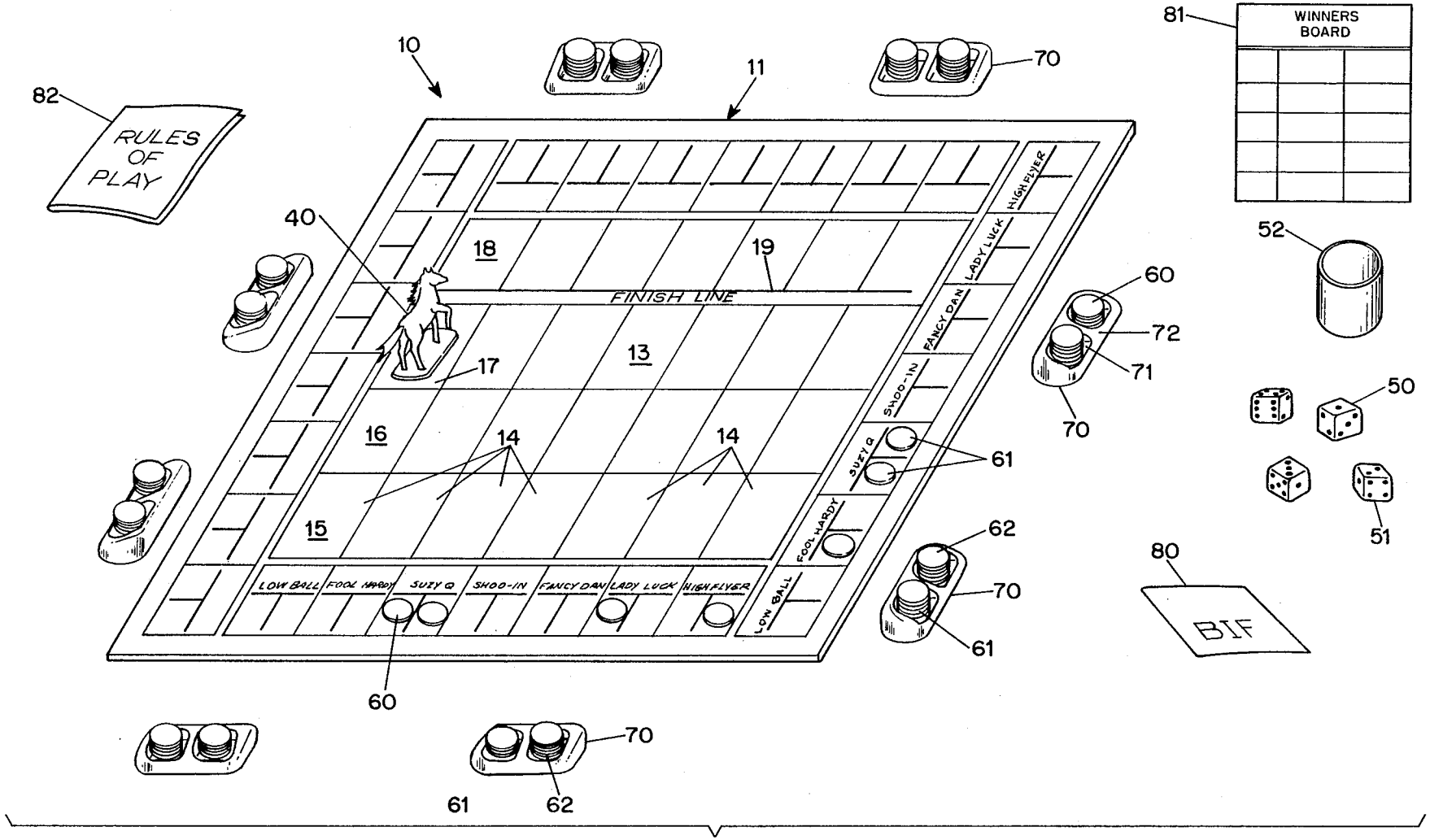
FIG. 1 is a somewhat schematic top perspective view of the game of the invention, showing all of the components of the game.

Referring more particularly to the drawings, the game according to the invention is designated generally at 10, and comprises a flexible playing board or sheet 11 of foam or felt-like material 12 having a smooth, relatively slick plastic playing surface 13.

The playing surface is marked with indicia to define seven racing lanes 14, each being subdivided into four spaces 15, 16, 17 and 18 along the length thereof, with the first space 15 in each lane representing a starting box or space. A finish line 19 is interposed between the last and next-to-last spaces 17 and 18.

Figure 2:
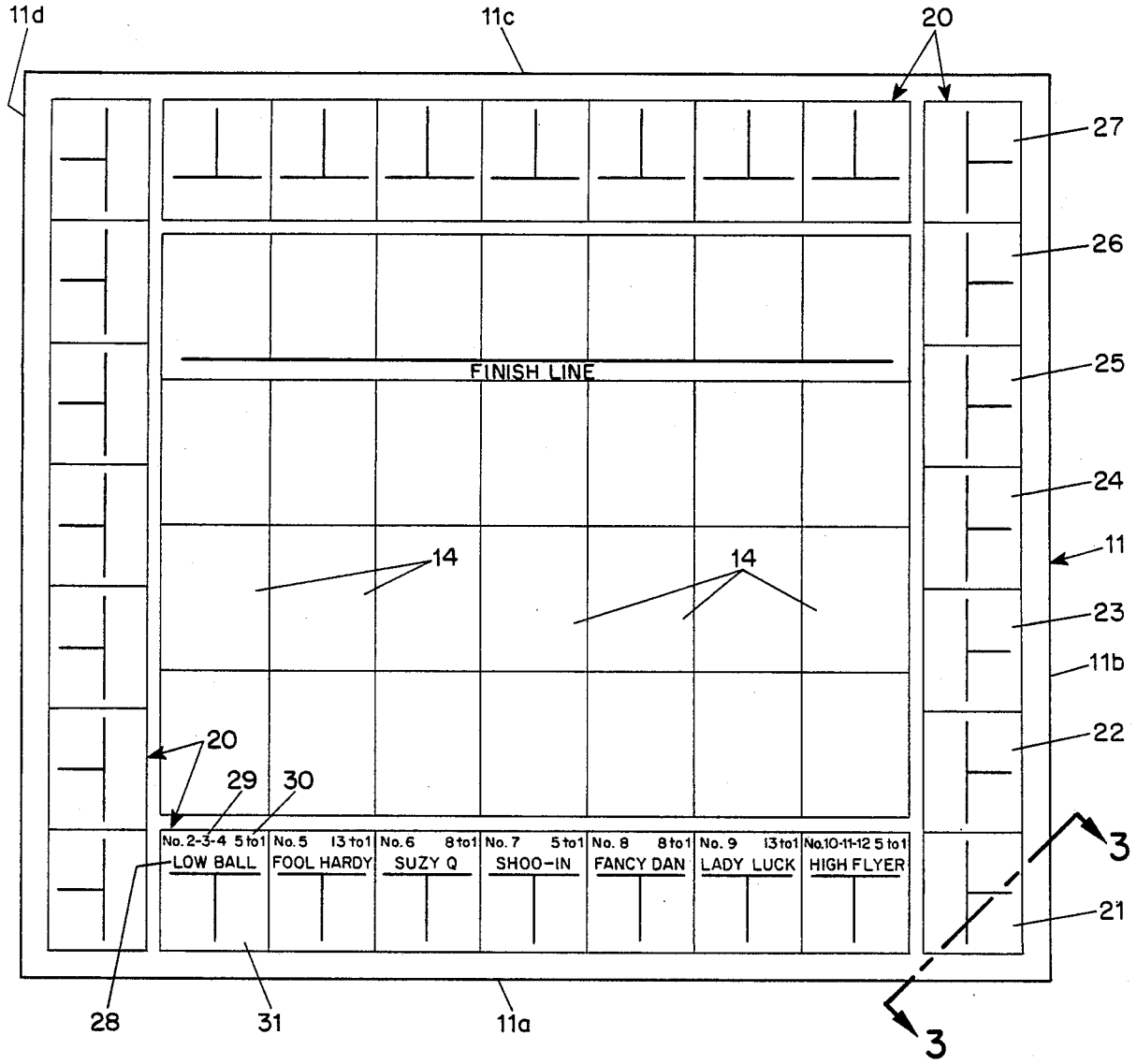
FIG. 2 is a top plan view of the playing surface or game board of the invention.
Figure 3:
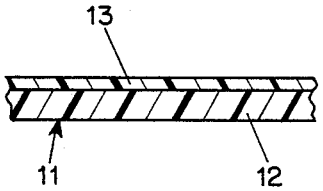
FIG. 3 is a transverse sectional view taken along line 3—3 in FIG. 2.

As seen best in FIG. 2, the playing board or sheet 11 is essentially square in plan view, having four edges 11*a*, 11*b*, 11*c* and 11*d*. Identical sets of indicia 20 are provided on the playing surface along each of the four edges, with each set comprising a number of squares or spaces 21–27 corresponding to the number of horses in the game. Each square contains the name 28 of a horse, that horses number 29, the odds 30 of that horse winning, and an area 31 for placing two bets. Further, the indicia along the edges 11*a* and 11*c* is organized so that the spaces containing the names, etc. of the horses align with the racing lanes 14, which run in a direction extending between the edges 11*a* and 11*c*.

The game also includes seven playing pieces 40–46, shaped as miniature horses, for placement in the respective racing lanes 14 and movement along the spaces 15–18 in the lane. Each horse has a name, such as High Flyer, Lady Luck, Shoo-In, etc., and a number. For instance, the horse named High Flyer is assigned the numbers 10, 11 and 12, while the horse named Shoo-In is assigned the number 7 and the horse named Lady Luck is assigned the number 9. The other horses are named and numbered as shown in the drawing, particularly FIG. 2.

Two pairs of dice 50 and 51 are also provided, with one set being black with white spots and the other being white with black spots. Thus, a player may change dice for good luck. The dice are conventionally configured, with from one to six spots on the respective faces, whereby eleven numbers from two to twelve may be obtained by rolling a pair of dice and totaling the numbers of dots on the top faces. A cup 52 is provided for holding, shaking and rolling the dice.

In order to place bets and determine winners, etc., a plurality of markers 60 are provided, including blue markers 61 having a value of five points each, and red markers 62 having a value of one point each. The blue markers 61 are used for play-offs and winnings, etc., while the red markers 62 are used for placing bets during the regular races.

Holders or racks 70 for holding the markers are divided into two compartments 71 and 72. At the start of a game, each player is given ten blue markers and twenty red markers for a total point value of seventy. Eight racks 70 are provided with the game, whereby two players may place their racks and markers along each side of the playing sheet 11.

A Banker's Insurance Fund pouch 80 for holding 25 blue markers 61, for example, and a winner's board 81 (see FIG. 2) are also included for purposes to be later described, along with a rules sheet 82 containing the rules of play.

The game is designed as a game of pure chance simulating a fast Quarter Horse race between seven horses. The winning horse must move only three times in order to cross the finish line and win the race, with a roll of the dice determining which horse advances in its lane. Thus, if the number of dots showing on the top surfaces of a pair of dice equals the number of one of the horses, that horse advances one space in its lane. The 36 possible combinations of the two dice are allocated to the seven horses so that there are six combinations which will result in advancement of each of three of the horses (horses numbered 2–3–4, 7 and 10–11–12), five combinations for advancement of two horses (horses numbered 6 and 8), and four combinations for advancement of two more horses (horses numbered 5 and 9). These possible combinations for the various horses in conjunction with the need for only three moves for any one horse to win result in odds to win for the three groups of horses as follows: horses numbered 2–3–4, 7 and 10–11–12 have odds of 5:1; horses numbered 6 and 8 have odds of 8:1; and horses numbered 5 and 9 have odds of 13:1. These odds were calculated by using the Fair Betting Odds procedure, including the playing of 1,500 games with the recording of the number of rolls of the dice and the winning horses for these games. Table 1 sets forth this data and the calculated odds.

Each player starts each game with a rack containing 10 blue markers and 20 red markers, for a total point count of 70. The players roll the dice and the player rolling a "7" is designated the "Starter Banker". The Starter Banker's responsibilities are to roll the dice, move the horses on the playing surface, collect the losing bets and pay the winning bets. A new Starter Banker is determined at the beginning of each game, with each player, in turn, acting in this capacity. The player with the greatest number of points, or increase in points, at the conclusion of a game is the winner and that person's name is posted on the winner's board to qualify for the prize to be awarded to the player with the highest number of points at the end of three games. A game is normally over when eight races have been completed, although the number of players determines when a game is over. That is, when there are six or fewer players, the Starter Banker will conduct two races before a new Starter Banker is determined.

The markers are redistributed at the beginning of each new game so that each player starts each game with markers totaling 70 points.

In the event that the Starter Banker does not have enough markers to pay all winning bets, payment is made from the Bankers Insurance Fund pouch. One red marker is given to the bankrupt Starter Banker at the beginning of each race so that that person can continue playing on a "one bet" basis.

Each player must bet only two red markers in each race. The bet may be distributed between two horses, or both markers may be bet on the same horse. Accordingly, each player is committed to the same amount bet for each race, but different horses may obviously be bet on by the respective players. This results in the betting of all players being equal, and the increase or decrease in each player's markers results from that player's luck in picking the winning horses. Since only one player wins in each game and subsequent games are begun with all players having a full rack of markers, the chance for losing players to recover is enhanced, adding to the fun of the game.

It has been found that a winning horse will be produced with from four to twelve rolls of the dice, with eight rolls being the average. This takes only about one minute. Accordingly, it should be apparent that the game is fast-paced.

Moreover, the rack or holder for the markers is designed so that it is full when it contains ten blue markers and twenty red markers. Thus, it is easy for a player to ascertain the "increase" in his markers at the end of each game and prior to redistribution of the markers before the next game. Only players with full racks need count their "increase".

The flexible playing board 11 measures 24×22 inches and comes with eight racks of markers, two sets of dice with a cup, a winner's board and the Banker's Insurance Fund (BIF) packet or pouch. The game may be played with from four to sixteen people.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. A game for simulating a race of equal moves comprising:

a playing surface having a plurality of racing lanes each being subdivided into an equal number of advancement spaces including a starting space and a finishing space;

a plurality of playing pieces corresponding to said number of racing lanes; and means for determining the advancement of said playing pieces, said means having indicia such that the probability of at least one playing piece being advanced and reaching the finishing space first is different from that of said other playing pieces.

2. A game according to claim 1 wherein said playing surface has indicia corresponding to said indicia of said determining means.

3. A game according to claim 2 wherein said playing surface is rectangular and further comprises at least one set of boxes, each of said boxes corresponding to one of said playing pieces and having indicia corresponding to said means for determining the advancement of said playing pieces.

4. A game according to claim 3 wherein each of said boxes further includes betting odds for said playing piece, said betting odds being determined by using a Fair Betting Odds procedure.

5. A game according to claim 3 wherein each of said boxes further includes a betting space for placing a bet for the playing piece corresponding to said box.

6. A game according to claim 3 wherein said playing surface has one set of said boxes along each edge of said rectangular playing surface.

7. A game according to claim 1 wherein said playing pieces have indicia corresponding to said indicia of said determining means.

8. A game according to claim 1 wherein said means for determining the advancement of said playing pieces is a pair of dice having conventional markings for determining a plurality of numbers between two and twelve and each of said playing pieces has indicia corresponding to at least one number determined from said dice.

9. A game according to claim 8 wherein each of said racing lanes is subdivided into four advancement spaces including said starting space and said finishing space.

10. A game according to claim 1 further comprising a plurality of betting markers for indicating said bet on one of said playing pieces.

11. A game according to claim 10 further comprising at least one holder for holding said betting markers, said holder being designed to indicate whether a predetermined number of each of said markers is contained in said holder.

12. A game according to claim 11 wherein at least two of said playing pieces have equal probability of being advanced.

13. A method for simulating a race comprising the steps of:

designating a plurality of racing lanes on a playing surface;

subdividing each of said lanes into an equal number of advancement spaces along the length of said racing lanes, including a starting space and a finishing space;

assigning to each of a plurality of playing pieces indicia wherein said indicia correspond to a possible roll of a set of dice;

assigning a set of odds to said playing pieces such that the probability, determined empirically, of the roll from the set of dice that corresponds to one of said playing pieces relates to the odds assigned to said playing piece and the odds of at least one playing piece being different from that of the other playing pieces;

placing said playing pieces on said starting spaces;

rolling the set of dice;

advancing the playing piece corresponding to the roll with the set of dice by an advancement of at least one space; and repeating the steps of rolling and advancing, wherein the advancement of any of said playing pieces being the same until one playing piece has advanced to the finishing space.

14. The method according to claim 13 comprising the step of providing four advancement spaces to each of said racing lanes.

15. The method according to claim 14 further comprising the step of designating along each side edge of said playing board a set of indicia having a betting space representative of each playing piece to be raced, with each betting space including the name and indicia of the playing piece and the odds for that playing piece to win the race.

16. The method according to claim 15 comprising the step of assigning two numbers as indicia to at least one of said playing pieces.

17. The method according to claim 16 comprising the step of assigning three numbers as indicia to at least one of said playing pieces.

18. The method according to claim 17 comprising the step of assigning the same indicia to at least two playing pieces.

* * * * *